US010215125B2

(12) United States Patent
Sixel et al.

(10) Patent No.: US 10,215,125 B2
(45) Date of Patent: Feb. 26, 2019

(54) PROCESS OF CONTROLLING OPERATION IN A MULTI-CYLINDER ENGINE

(71) Applicant: Caterpillar Motoren GmbH & Co. KG, Kiel (DE)

(72) Inventors: Eike Joachim Sixel, Kiel (DE); Andre Schmidt, Rostock (DE); Adam Stubbs, Linconshire (GB); Kai Ruschmeyer, Fintel (DE); Christian Hoffmann, Rostock (DE)

(73) Assignee: Caterpillar Motoren GmbH & Co. KG, Kiel (DE)

( * ) Notice: Subject to any disclaimer, the term of this patent is extended or adjusted under 35 U.S.C. 154(b) by 0 days.

(21) Appl. No.: 15/403,373

(22) Filed: Jan. 11, 2017

(65) Prior Publication Data

US 2017/0204802 A1 Jul. 20, 2017

(30) Foreign Application Priority Data

Jan. 15, 2016 (GB) ..... 1600767.6

(51) Int. Cl.
*F02D 41/30* (2006.01)
*F02D 41/12* (2006.01)
(Continued)

(52) U.S. Cl.
CPC ..... *F02D 41/3076* (2013.01); *F02B 75/18* (2013.01); *F02D 17/02* (2013.01);
(Continued)

(58) Field of Classification Search
CPC ..... F02D 41/3076; F02D 41/0087; F02D 41/123; F02D 13/06; F02D 17/023; F02D 17/02
(Continued)

(56) References Cited

U.S. PATENT DOCUMENTS 4,509,488 A 4/1985 Förster et al.
5,038,739 A * 8/1991 Ishii ..... F02B 29/00 123/198 F
(Continued)

FOREIGN PATENT DOCUMENTS

EP 1022450 3/2005
GB 2317716 4/1998
(Continued)

OTHER PUBLICATIONS

U.K. Search Report dated Jun. 24, 2016, issued in U.K. Application No. GB 1600767.6 (1 page).

*Primary Examiner* — Mahmoud Gimie

(57) ABSTRACT

A process of controlling operation in a multi-cylinder engine either during start of operation or low-load conditions is disclosed. The process may include skipping a supply of fuel in a first set of cylinders of the multi-cylinder engine for a pre-defined number of multiple working cycles. The process may further include supplying fuel-air mixture to a second set of cylinders of the multi-cylinder engine for the pre-defined number of multiple working cycles. The process may also include executing combustion of the fuel-air mixture supplied to the second set of cylinders for the pre-defined number of multiple working cycles. In addition the process may include either changing a selection of cylinders included in the first set of cylinders and the second set of cylinders respectively, or switching the supply of fuel, after the pre-defined number of multiple working cycles, from the second set of cylinders to the first set of cylinders.

19 Claims, 11 Drawing Sheets

| | CYLINDER \ WORKING CYCLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | F | F | F | F | F | F | – | – | F | F | F | F | F | F | – | – | F | F | F | F | F | F |
| 106 | 2 | F | F | – | – | F | F | F | F | F | F | – | – | F | F | F | F | F | F | – | – | F | F | F | F |
| 110 | 3 | F | F | F | F | – | – | F | F | F | F | F | F | – | – | F | F | F | F | F | F | – | – | F | F |
| 112 | 4 | F | F | F | F | F | F | – | – | F | F | F | F | F | F | – | – | F | F | F | F | F | F | – | – |

– *denotes skip-firing*
F *denotes firing*

(51) Int. Cl.

| | |
|---|---|
| ***F02D 17/02*** | (2006.01) |
| ***F02D 41/00*** | (2006.01) |
| ***F02B 75/18*** | (2006.01) |
| *F02D 41/06* | (2006.01) |
| *F02D 41/08* | (2006.01) |
| *F02D 13/06* | (2006.01) |

(52) U.S. Cl.
CPC ..... *F02D 17/023* (2013.01); *F02D 41/0082* (2013.01); *F02D 41/0087* (2013.01); *F02D 41/123* (2013.01); *F02D 13/06* (2013.01); *F02D 41/062* (2013.01); *F02D 41/086* (2013.01)

(58) Field of Classification Search
USPC ..... 123/481, 198 F, 491
See application file for complete search history.

(56) References Cited

U.S. PATENT DOCUMENTS 5,154,151 A * 10/1992 Bradshaw ..... B60K 28/16 123/198 F
5,287,279 A * 2/1994 Anan ..... F02D 41/0087 123/333
5,377,631 A 1/1995 Schechter
5,540,633 A * 7/1996 Yamanaka ..... F02D 11/105 123/198 F
5,778,858 A * 7/1998 Garabedian ..... F02D 41/1443 123/481
5,826,563 A 10/1998 Patel et al.
5,884,603 A * 3/1999 Matsuki ..... B60K 28/16 123/198 F
6,360,724 B1 * 3/2002 Suhre ..... F02D 17/02 123/198 F
2010/0043744 A1 * 2/2010 Suzuki ..... F02B 77/08 123/260
2011/0174256 A1 * 7/2011 Aso ..... F02D 41/0082 123/179.4
2014/0069379 A1 3/2014 Beikmann

FOREIGN PATENT DOCUMENTS

JP 09-264163 10/1997
WO WO 2015/042054 3/2015

* cited by examiner

| | CYLINDER \ WORKING CYCLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | F | F | F | F | F | F | – | – | F | F | F | F | F | F | – | – | F | F | F | F | F | F |
| 106 | 2 | F | F | – | – | F | F | F | F | F | F | – | – | F | F | F | F | F | F | – | – | F | F | F | F |
| 110 | 3 | F | F | F | F | – | – | F | F | F | F | F | F | – | – | F | F | F | F | F | F | – | – | F | F |
| 112 | 4 | F | F | F | F | F | F | – | – | F | F | F | F | F | F | – | – | F | F | F | F | F | F | – | – |

– denotes skip–firing
F denotes firing

FIG. 2

| | CYLINDER \ WORKING CYCLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | – | F | F | F | F | F | F | F | F | F | – | – | – | F | F | F | F | F | F | F | F | F |
| 106 | 2 | F | F | F | – | – | – | F | F | F | F | F | F | F | F | F | – | – | – | F | F | F | F | F | F |
| 110 | 3 | F | F | F | F | F | F | – | – | – | F | F | F | F | F | F | F | F | F | – | – | – | F | F | F |
| 112 | 4 | F | F | F | F | F | F | F | F | F | – | – | – | F | F | F | F | F | F | F | F | F | – | – | – |

– denotes skip-firing

F denotes firing

FIG. 3

| | CYLINDER \ WORKING CYCLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | – | – | F | F | F | F | F | F | F | F | F | F | F | F | – | – | – | – | F | F | F | F |
| 106 | 2 | F | F | F | F | – | – | – | – | F | F | F | F | F | F | F | F | F | F | F | F | – | – | – | – |
| 110 | 3 | F | F | F | F | F | F | F | F | – | – | – | – | F | F | F | F | F | F | F | F | F | F | F | F |
| 112 | 4 | F | F | F | F | F | F | F | F | F | F | F | F | – | – | – | – | F | F | F | F | F | F | F | F |

– denotes skip-firing
F denotes firing

FIG. 4

| | CYLINDER \ WORKING CYCLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | F | F | – | – | F | F | – | – | F | F | – | – | F | F | – | – | F | F | – | – | F | F |
| 106 | 2 | – | – | F | F | – | – | F | F | – | – | F | F | – | – | F | F | – | – | F | F | – | – | F | F |
| 110 | 3 | F | F | – | – | F | F | – | – | F | F | – | – | F | F | – | – | F | F | – | – | F | F | – | – |
| 112 | 4 | F | F | – | – | F | F | – | – | F | F | – | – | F | F | – | – | F | F | – | – | F | F | – | – |

– denotes skip–firing
F denotes firing

FIG. 5

| | CYLINDER \ WORKING CYCLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | – | F | F | F | – | – | – | F | F | F | – | – | – | F | F | F | – | – | – | F | F | F |
| 106 | 2 | – | – | – | F | F | F | – | – | – | F | F | F | – | – | – | F | F | F | – | – | – | F | F | F |
| 110 | 3 | F | F | F | – | – | – | F | F | F | – | – | – | F | F | F | – | – | – | F | F | F | – | – | – |
| 112 | 4 | F | F | F | – | – | – | F | F | F | – | – | – | F | F | F | – | – | – | F | F | F | – | – | – |

– denotes skip–firing
F denotes firing

FIG. 6

| | WORKING CYCLE / CYLINDER | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | – | – | F | F | F | F | – | – | – | – | F | F | F | F | – | – | – | – | F | F | F | F |
| 106 | 2 | – | – | – | – | F | F | F | F | – | – | – | – | F | F | F | F | – | – | – | – | F | F | F | F |
| 110 | 3 | F | F | F | F | – | – | – | – | F | F | F | F | – | – | – | – | F | F | F | F | – | – | – | – |
| 112 | 4 | F | F | F | F | – | – | – | – | F | F | F | F | – | – | – | – | F | F | F | F | – | – | – | – |

– denotes skip–firing
F denotes firing

FIG. 7

| | WORKING CYCLE / CYLINDER | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | F | F | – | – | – | – | – | – | F | F | – | – | – | – | – | – | F | F | – | – | – | – |
| 106 | 2 | – | – | – | – | – | – | F | F | – | – | – | – | – | – | F | F | – | – | – | – | – | – | F | F |
| 110 | 3 | – | – | – | – | F | F | – | – | – | – | – | – | F | F | – | – | – | – | – | – | F | F | – | – |
| 112 | 4 | F | F | – | – | – | – | – | – | F | F | – | – | – | – | – | – | F | F | – | – | – | – | – | – |

– denotes skip–firing
F denotes firing

FIG. 8

| | CYLINDER \ WORKING CYCLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | – | F | F | F | – | – | – | – | – | – | – | – | – | F | F | F | – | – | – | – | – | – |
| 106 | 2 | – | – | – | – | – | – | – | – | – | F | F | F | – | – | – | – | – | – | – | – | – | F | F | F |
| 110 | 3 | – | – | – | – | – | – | F | F | F | – | – | – | – | – | – | – | – | – | F | F | F | – | – | – |
| 112 | 4 | F | F | F | – | – | – | – | – | – | – | – | – | F | F | F | – | – | – | – | – | – | – | – | – |

– denotes skip–firing
F denotes firing

FIG. 9

| | CYLINDER \ WORKING CYCLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 108 | 1 | – | – | – | – | F | F | F | F | – | – | – | – | – | – | – | – | – | – | – | – | F | F | F | F |
| 106 | 2 | – | – | – | – | – | – | – | – | – | – | – | – | F | F | F | F | – | – | – | – | – | – | – | – |
| 110 | 3 | – | – | – | – | – | – | – | – | F | F | F | F | – | – | – | – | – | – | – | – | – | – | – | – |
| 112 | 4 | F | F | F | F | – | – | – | – | – | – | – | – | – | – | – | – | F | F | F | F | – | – | – | – |

– denotes skip-firing
F denotes firing

FIG. 10

PROCESS OF CONTROLLING OPERATION IN A MULTI-CYLINDER ENGINE

CLAIM FOR PRIORITY

This application claims benefit of priority of United Kingdom Patent Application No. GB 1600767.6, filed Jan. 15, 2016, which is incorporated herein by reference.

TECHNICAL FIELD

The present disclosure relates to a process of controlling operation in a multi-cylinder engine. More particularly, the present disclosure relates to a control strategy for skipping a supply of fuel into one or more cylinders of a multi-cylinder engine.

BACKGROUND

Internal combustion engines have long been implemented with various control strategies for skipping a supply of fuel in one or more cylinders of an engine and subsequently, omitting a firing event in cylinders of the engine to which the supply of fuel has been skipped.

For reference, U.S. Pat. No. 5,377,631 (hereinafter referred to as 'the '631 patent') relates to strategies for operating a four cycle engine in a skip-cycle manner. The '631 patent discloses providing the engine with a valve control so that each intake and exhaust valve for each cylinder can be individually activated or deactivated essentially instantaneously to provide a skip-cycle pattern that varies as a function of the load. Each of the valves permits changing the purpose of the stroke of each piston of each deactivated cylinder from compression to exhaust or intake to expansion, as the case may be, to assure firing of all of the engine cylinders within as short a period as one skip cycle to prevent cylinder cool-down, which promotes emissions. Un-throttled operation also is provided by closing the intake and exhaust valves in a particular sequence during skip cycle operation, and controlling the intake valve closure timing during load periods between skip cycle periods to continue un-throttled operation for all load levels. Further individual activation or deactivation of the fuel injectors and spark plugs enhances the skip cycle and un-throttled operation.

However, in most cases, it has been observed that a common pattern of skipping the supply of fuel-air mixture, and subsequently omitting the firing in cylinders is to skip the supply of fuel-mixture in a given cylinder for merely one working cycle of the engine at a time and repeating such skip-firing in rest of the cylinders sequentially.

Although skipping a supply of fuel and subsequent combustion in a given cylinder for merely one cycle at a time may be advantageous in various operating conditions of the engine, during a start of the engine and/or a low-load condition of the engine, a quick alternation of skip-firing from one cylinder to the next may result in a majority of the cylinders having an average temperature of the engine. However, for a large number of cylinders in a given engine, this temperature of the skipped cylinders may still be too cold for having a complete combustion of the fuel-air mixture in the cylinders of the engine.

Hence, there is a need for control strategies that enable a more effective skip-firing pattern while also maintaining optimum performance by internal combustion engines during start and low-load conditions.

SUMMARY OF THE DISCLOSURE

In an aspect of the present disclosure, a process of controlling operation in a multi-cylinder engine during start of operation and low-load conditions includes skipping a supply of fuel in a first set of cylinders for a pre-defined number of multiple working cycles; supplying fuel-air mixture to a second set of cylinders in the multi-cylinder engine for the pre-defined number of multiple working cycles; executing combustion of the fuel-air mixture supplied to the second set of cylinders for the pre-defined number of multiple working cycles; and switching the supply of fuel, after the pre-defined number of multiple working cycles, from the second set of cylinders to the first set of cylinders.

In another aspect of the present disclosure, a control system is provided for controlling operation in a multi-cylinder engine having a fuel-supply system and an ignition system coupled thereto. The control system includes a sensor module and a controller communicably coupled to the sensor module. The sensor module includes a plurality of sensors that are configured to detect at least one of: a start of operation of the engine; a low-load condition of the engine; and an input to the engine.

The controller is configured to receive the signals from the sensor module, the signals being indicative of at least one of: a start of operation of the engine; and a low-load condition of the engine. The controller then controls the fuel-supply system for: skipping a supply of fuel in a first set of cylinders for a pre-defined multiple number of working cycles; and supplying fuel-air mixture to a second set of cylinders for the pre-defined multiple number of working cycles. The controller then controls the ignition system for executing combustion of the fuel-air mixture supplied to the second set of cylinders for the pre-defined number of multiple working cycles. Thereafter, the control system controls the fuel-supply system for switching the supply of fuel, after the pre-defined number of multiple working cycles, from the second set of cylinders to the first set of cylinders.

Other features and aspects of this disclosure will be apparent from the following description and the accompanying drawings.

BRIEF DESCRIPTION OF THE DRAWINGS

FIGS. 2-10 are exemplary tabular representations of various skip-firing patterns that can be implemented in the multi-cylinder engine of FIG. 1 in accordance with embodiments of the present disclosure.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
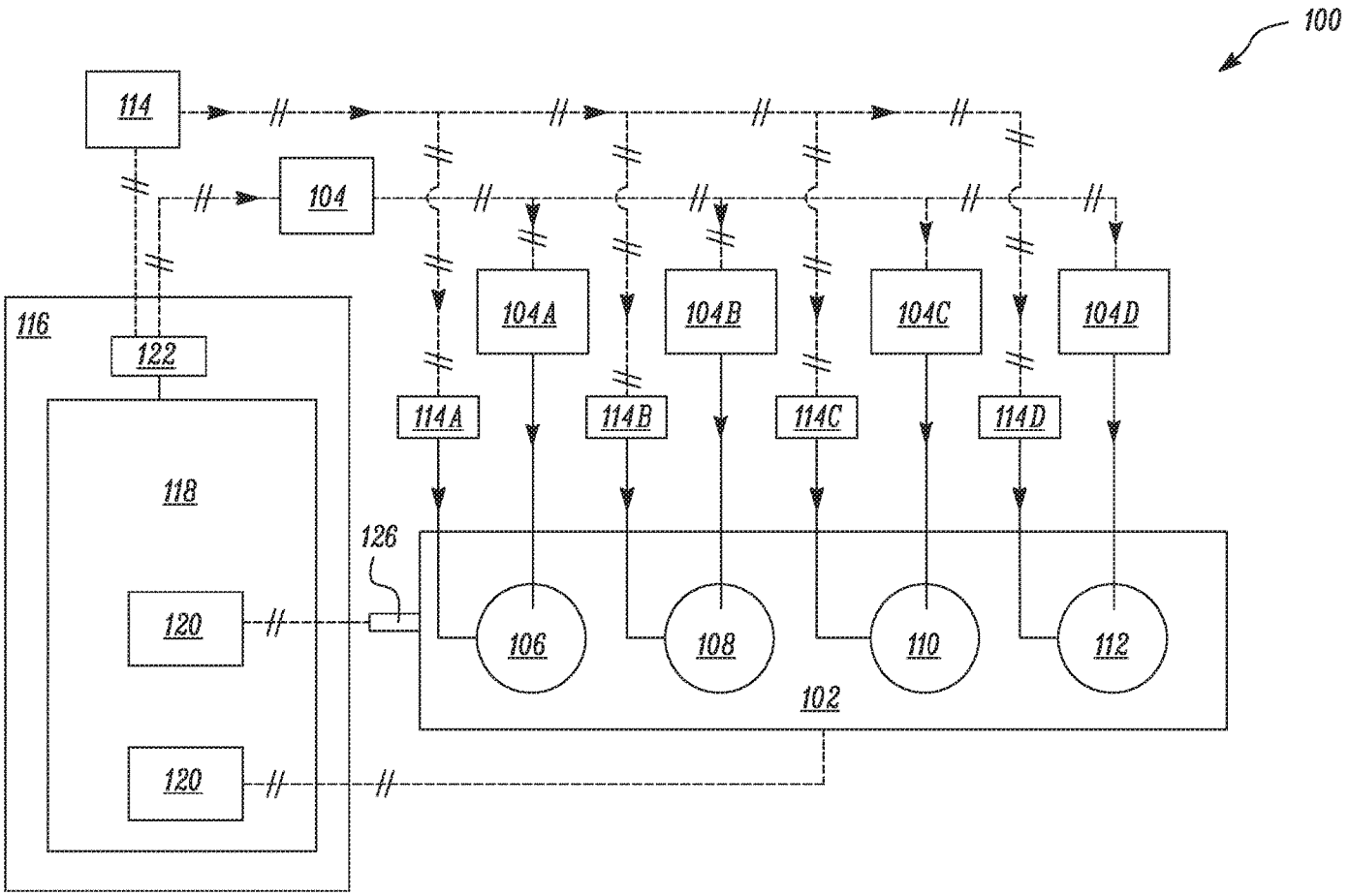
FIG. 1 is a diagrammatic illustration of an engine system having a multi-cylinder engine, in which embodiments of the present disclosure can be implemented.

The present disclosure relates to a control system for a fuel supply system and an ignition system associated with cylinders of a multi-cylinder engine. FIG. 1 shows a schematic of an engine system 100 in which disclosed embodiments may be implemented. The engine system 100 includes a multi-cylinder engine 102 having one or more cylinders 106, 108, 110 and 112. Although four cylinders 106, 108, 110 and 112 are shown in the illustrated embodiment of FIG. 1, it may be noted that in other embodiments, the multi-cylinder engine 102 can include fewer or more cylinders therein for e.g., two or more cylinders. Moreover, although the present disclosure is explained in conjunction with a four cylinder engine as shown in FIG. 1, it should be noted that systems and methods disclosed earlier can be equally implemented and applied in engines having at least two or more cylinders therein without deviating from the spirit of the present disclosure.

In one embodiment, the multi-cylinder engine 102 may be used to drive power generating assemblies such as generators. In other embodiments, the multi-cylinder engine 102 may be used to drive other mechanical assemblies such as compressors. In one embodiment, the multi-cylinder engine 102 may be a reciprocating engine. In an embodiment, the multi-cylinder engine 102 may be a two stroke internal combustion engine. In another embodiment, the multi-cylinder engine 102 may be a four stroke internal combustion engine.

In an embodiment, the multi-cylinder engine 102 may be configured to operate on varying thermodynamic cycles. In an embodiment of this disclosure, the multi-cylinder engine 102 may be configured to operate on an Otto cycle. Accordingly, the multi-cylinder engine 102 may use any spark ignited fuel compatible with the Otto cycle, for example, gasoline, natural gas, synthesis gas (syngas) and the like.

The engine system 100 further includes a fuel-supply system 104 having multiple outlets 104*a*, 104*b*, 104*c*, and 104*d* associated with the cylinders 106, 108, 110, and 112 of the multi-cylinder engine 102. The fuel-supply system 104 is configured to deliver a supply of fuel alone, air alone, or a mixture of fuel and air to the multi-cylinder engine 102. In an embodiment the engine system 100 may further include an ignition system 114 having an ignition source 114*a*, 114*b*, 114*c*, and 114*d* associated with each of the cylinders 106, 108, 110, and 112. The ignition sources 114 may be configured to ignite the spark ignited fuel. In an embodiment as shown in FIGS. 2-17, the ignition sources 114 may be spark plugs. However, a person having ordinary skill in the art may acknowledge that other ignition sources 114 commonly known in the art may be used to ignite the spark ignited fuel.

As shown in FIG. 1, the engine system 100 further includes a control system 116 operatively connected to the fuel delivery systems 104. The control system 116 includes a sensor module 118, and a controller 122 communicably coupled to the sensor module 118. The sensor module 118 includes multiple sensors 120. Two sensors 120 shown in the illustrated embodiment of FIG. 2. However, in alternative embodiments, it can be contemplated to use fewer or more number of sensors depending on specific requirements of an application.

In one embodiment as shown herein, one of the sensors 120 may be communicably coupled to the engine 102 while another of the sensors 120 may be connected to an output shaft 126 of the engine 102. The sensors 120 may be configured to detect a start of operation of the engine 102 and/or a low load condition of the engine 102. However, various other sensors may be additionally or optionally included in the engine system 100 to detect other operational parameters of the engine system 100 without deviating from the spirit of the present disclosure.

The controller 122 may receive signals from the sensor module 118, the signals being indicative of at least one of: a start of operation of the engine 102; and a low-load condition of the engine 102. Upon receiving such signals from one or more sensors 120 of the sensor module 118, the controller 122 is configured to control the fuel-supply system 104 for skipping a supply of fuel in a first set of cylinders from the cylinders 106, 108, 110, and 112 for a pre-defined multiple number of working cycles. Simultaneously or tandemly, the controller 122 is also configured to control the fuel-supply system 104 for supplying a fuel-air mixture to a second set of cylinders, from the set of the cylinders 106, 108, 110, for the pre-defined multiple number of working cycles.

In embodiments disclosed herein, the terms "the first set of cylinders" can be regarded as being inclusive of one or more cylinders from the set of cylinders 106, 108, 110, and 112 present in the multi-cylinder engine 102. Similarly, the terms 'the second set of cylinders" can be regarded as being inclusive of one or more cylinders from the set of cylinders 106, 108, 110, and 112 present in the multi-cylinder engine 102. Further, it should be noted that the first set of cylinders and the second set of cylinders are mutually exclusive of each other. However, a sum of the number of cylinders present in the first set of cylinders and the number of cylinders present in the second set of cylinders can be construed as being representative of a total number of cylinders present in the multi-cylinder engine 102.

For example, with regards to the four-cylinder engine 102 disclosed in FIG. 1, in one embodiment—the first set of cylinders can include one cylinder for e.g., cylinder 106; while the second set of cylinders can include three cylinders for e.g., cylinder 108, 110, and 112. In another embodiment, the first set of cylinders can include two cylinders for e.g., cylinders 106 and 108; while the second set of cylinders can include the remaining cylinders for e.g., cylinder 110, and 112. In yet another embodiment, the first set of cylinders can include three cylinders for e.g., cylinders 106, 108 and 110; while the second set of cylinders can include the remaining one cylinder i.e., cylinder 112.

Moreover, it should be noted that the cylinders 106, 108, 108, and 110 may form part of the first and second sets of cylinders in any order respectively. For example, cylinders 106, 110 and 112 from the engine 102 can form part of the first set of cylinders while cylinder 108 can form part of the second set of cylinders. In another example, cylinders 106, 112 may form part of the first set of cylinders while cylinders 108, 110 form part of the second set of cylinders. Therefore, notwithstanding anything contained in this document, any order of cylinders may be chosen to form part of the first set of cylinders or the second set of cylinders depending on specific requirements of an application and such order should not be construed, in any way, as being limiting of this disclosure. Rather, any references to orders of cylinders, forming part of the first and second sets of cylinders disclosed herein, should be taken by way of example to help in understanding the present disclosure.

Further, the terms "working cycle" disclosed herein can be regarded as being representative of for e.g., two strokes executed by pistons (not shown) of the engine 102, or for e.g., four strokes executed by pistons of the engine 102 depending on whether the engine 102 is a two-stroke engine or a four-stroke engine. As such, the present disclosure is not limited by way of a number of strokes forming part of a working cycle in the engine. Rather, systems and methods disclosed herein can be equally applied to engines operating on working cycles comprising any number of strokes therein.

As disclosed earlier herein, upon receiving signals indicative of start of operation or low-load condition from one or more sensors 120 of the sensor module 118, the controller 122 controls the fuel-supply system 104 for skipping a supply of fuel in the first set of cylinders and for supplying the fuel, in a simultaneous or tandem manner, to the second set of cylinders from the set of cylinders 106, 108, 110 present in the multi-cylinder engine 102, for the pre-defined multiple number of working cycles. It should be noted that in embodiments disclosed herein, a fuel supply for ignition i.e., pre-chamber gas supply in case of a spark ignited pre-chamber Otto gas engine, or ignition Diesel fuel in case of a Diesel-Gas engine or a Dual Fuel engine could be delivered continuously to both—the first and second sets of cylinders without deviating from the spirit of the present disclosure.

In an embodiment of the present disclosure, the pre-defined number of multiple working cycles includes at least two consecutive working cycles. In one example, the pre-defined number of working cycles may include two consecutive working cycles. In another example, the pre-defined number of working cycles may include three consecutive working cycles. In another example, the pre-defined number of working cycles may include four consecutive working cycles. However, it is hereby contemplated that in a preferred embodiment of this disclosure, the pre-defined number of working cycles include at least four or more consecutive working cycles for e.g., 20 consecutive working cycles, 25 consecutive working cycles, and so on.

Moreover, the controller 122 is further configured to control the ignition system for executing combustion of the fuel-air mixture supplied to the second set of cylinders for the pre-defined number of multiple working cycles for e.g., 20 working cycles.

Thereafter, the controller 122 is further configured to perform one of: a) a change in a selection of cylinders 106, 108, 110, and 112 from the multi-cylinder engine 102 that form the first set of cylinders and the second set of cylinders respectively; and b) control the fuel-supply system 104 for switching the supply of fuel, after the pre-defined number of multiple working cycles, from the second set of cylinders to the first set of cylinders. In one embodiment, upon completion of the pre-defined number of multiple working cycles, the controller 122 is configured to change a selection of cylinders 106, 108, 110, and 112 from the multi-cylinder engine 102 that form the first set of cylinders and the second set of cylinders respectively. Examples of this embodiment have been rendered herein by way of FIGS. 2-4 and FIGS. 8-10.

In another embodiment, upon completion of the pre-defined number of multiple working cycles, the controller 122 is configured to control the fuel-supply system 104 for switching the supply of fuel from the second set of cylinders to the first set of cylinders. Examples of this embodiment have been rendered herein by way of FIGS. 5-7.

Explanation pertaining to various examples of controlling operation of the multi-cylinder engine 102 of the present disclosure will now be made in conjunction with FIGS. 1-10. However, such explanation is to be taken in the illustrative sense and should not be construed, in any way, as being limiting of this disclosure. For purposes of the present disclosure, 'F' shown in FIGS. 2-10 denotes that supply of fuel-air mixture and subsequent combustion of the fuel-air mixture has been accomplished in one or more cylinders 106, 108, 110, and/or 112 while '-' denotes that supply of fuel has been omitted in one or more cylinders 106, 108, 110, and/or 112.

It may also be noted that in an embodiment of this disclosure, the controller 122 of the present disclosure is also configured to beneficially determine a number of cylinders from the engine 102 that should form part of the first set of cylinders and the second set of cylinders respectively. Additionally or optionally, the controller can also determine a number of working cycles for which the first set of cylinders would be devoid of fuel. These determinations may be made by the controller 122 based on various operating conditions of the engine 102. The operating conditions disclosed herein can include one or more of speed condition of the engine 102, load condition on the engine 102, and an input to the engine 102 for e.g., vis-à-vis the controller 122. The input provided to the engine 102 may be associated with for e.g., required speed demands, required torque demands and other numerous operating parameters of the engine 102.

For example, the controller 122 may determine that, at no-load condition, three cylinders, for e.g., cylinders 106, 108, and 110 would form part of the first set of cylinders while one cylinder, for e.g., cylinder 112 would form part of the second set of cylinders. Such examples have also been rendered herein by way of FIGS. 8-10. In another example, at 5% load condition, the controller 122 may determine that two cylinders, for e.g., cylinders 106 and 108 would form part of the first set of cylinders while two cylinders, for e.g., cylinders 110 and 112 would form part of the second set of cylinders. Such examples have also been rendered herein by way of FIGS. 5-7.

In an additional embodiment of this disclosure, it has also been contemplated that as the engine 102 moves through transient operating conditions i.e., changing conditions of speed and load, the controller 122 can dynamically vary a number of cylinders present in the first set of cylinders and a number of cylinders present in the second set of cylinders to meet various operational parameters of the engine system 100 and/or meet other specific requirements of an application. For example, at start of operation or no-load condition, the controller 122 may, as shown in FIGS. 8-10, command that supply of fuel and subsequent firing should be skipped in three cylinders at a time for at least two consecutive working cycles. Similarly, in another example, at 5% load, the controller 122 may, as shown in FIGS. 5-7, command that supply of fuel and subsequent firing should be skipped in two cylinders at a time for at least two consecutive working cycles. Similarly, in yet another example, at 15% load condition, the controller 122 may, as shown in FIGS. 2-4, command that supply of fuel and subsequent firing should be skipped in one cylinder at a time for at least two consecutive working cycles. It should be noted that during transient operating conditions, the controller 122 can vary the control schema for operation of the engine 102, in accordance with embodiments disclosed herein, from FIGS. 2 to 10 or vice-versa.

In an example as shown in FIG. 2, the first set of cylinders includes one of cylinders from the engine 102 for e.g., cylinder 108 while the remaining cylinders i.e., three cylinders 106, 110, and 112 form the second set of cylinders. Although cylinder 108 has been used as a starting cylinder to begin explanation of this example, any other cylinder i.e., cylinder 106, 110, 112 could be used in lieu of cylinder 108 to initially form part of the first set of cylinders. As shown, the supply of fuel and subsequent combustion has been omitted from cylinder 108 for two consecutive working cycles i.e., working cycle 1 and 2. During the occurrence of working cycles 1 and 2, it can be seen that the second set of cylinders i.e., cylinders 106, 110, and 112 continue to receive the supply of fuel-air mixture and also accomplish ignition or combustion of the fuel-air mixture therein.

Referring to FIGS. 1 and 2, upon completion of working cycles 1 and 2, the controller 122 can change a selection of cylinders 106, 108, 110, 112 from the multi-cylinder engine 102 forming the first set of cylinders and the second set of cylinders respectively. As shown, the controller 122 controls the fuel-supply system 104 to switch the skipping of supply of fuel from cylinder 108 to another of the cylinders for e.g., cylinder 106 as shown. Therefore, the fuel-supply system 104 now supplies fuel to cylinder 106 via corresponding fuel outlet 104*a* and shuts off supply of fuel via fuel outlet 104*b* to cylinder 108 as shown under working cycles 3 and 4, while the remaining cylinders 110, 112 still continue to form part of the second set of cylinders so as receive fuel-air mixture and execute combustion therein. Therefore, for working cycles 3 and 4, cylinder 106 can be regarded as forming part of the first set of cylinders while cylinders 108, 110, and 112 form part of the second set of cylinders. Moreover, the controller 122 also controls the ignition system 114 to skip firing or combustion from cylinder 106 for the two consecutive working cycles i.e., working cycles 3 and 4. However, during working cycles 3 and 4, it can also be seen that the second set of cylinders i.e., cylinders 108, 110, and 112 now receive the supply of fuel-air mixture and also accomplish ignition or combustion of the fuel-air mixture therein.

Similarly, upon completion of working cycles 3 and 4 i.e., in working cycles 5 and 6 as shown in FIG. 2, cylinder 110 is now included into the first set of cylinders while cylinders 106, 108, and 112 form part of the second set of cylinders. As shown in working cycles 5 and 6, supply of fuel and subsequent combustion has now been omitted from cylinder 110 while cylinders 106, 108, and 112 receive the fuel-air supply and such supply of fuel-air mixture also undergoes combustion. It is hereby contemplated that this pattern of skip-firing may continue so long as changes to the pattern of skip-firing are not triggered by the controller 122 vis-à-vis the fuel-supply system 104 and the ignition system 114. In various embodiments of the present disclosure, such changes can be beneficially governed by factors such as instantaneous changes in speed conditions and/or load conditions associated with the engine 102.

For the sake of simplicity and convenience, the function of 'skipping the supply of fuel and subsequent firing' in a given cylinder/s will hereinafter be referred as 'skip-firing' or equivalents thereof. In embodiments disclosed herein, it should be noted that although fuel supply may be skipped to one or more cylinders 106, 108, 110, and 112 of the engine 102, air supply may and subsequent firing may continue to occur in the skipped cylinders 106, 108, 110, and/or 112. Therefore, for purposes of the present disclosure, supply of air and/or execution of firing in a given cylinder/s of the engine 102 can be regarded as being independent of the supply of fuel into the given cylinder/s of the engine 102.

In another example as shown in FIG. 3, the controller 122 can control the fuel-supply system 104 and the ignition system 114 to execute skip-firing in one cylinder for e.g., cylinder 108 at a time for a maximum of three consecutive working cycles for e.g., working cycles 1, 2 and 3. In another example as shown in FIG. 4, the controller 122 can control the fuel-supply system 104 and the ignition system 114 to execute skip-firing in one cylinder for e.g., cylinder 108 at a time for a maximum of four consecutive working cycles for e.g., working cycles 1, 2, 3 and 4. Similarly, in other examples, the controller 122 can control the fuel-supply system 104 and the ignition system 114 to execute skip-firing in any one cylinder 106/108/110/112 at a time for a maximum of five or more consecutive working cycles.

In another example as shown in FIG. 5, the controller 122 can control the fuel-supply system 104 and the ignition system 114 to execute skip-firing in two cylinders for e.g., cylinders 106,108 at a time for a maximum of two consecutive working cycles for e.g., working cycles 1 and 2. Moreover, as shown in FIG. 5, upon completion of two working cycles for e.g. working cycles 1 and 2, it can be seen that the controller 122 also controls the fuel-supply system 104 and the ignition system 114 to switch the supply of fuel from the second set of cylinders for e.g., cylinders 110, 112 to the first set of cylinders for e.g., 106, 108.

In another example as shown in FIG. 6, the controller 122 can control the fuel-supply system 104 and the ignition system 114 to execute skip-firing in two cylinders for e.g., 106, 108 at a time for a maximum of three consecutive working cycles for e.g., working cycles 1, 2, and 3. In another example as shown in FIG. 7, the controller 122 can control the fuel-supply system 104 and the ignition system 114 to execute skip-firing in two cylinders for e.g., 106,108 at a time for a maximum of four consecutive working cycles for e.g., working cycles 1, 2, 3 and 4. Similarly, in other examples, the controller 122 can control the fuel-supply system 104 and the ignition system 114 to execute skip-firing in two cylinders for e.g., 106,108 or 110, 112 at a time for a maximum of five or more consecutive working cycles.

In another example as shown in FIG. 8, the controller 122 can control the fuel-supply system 104 and the ignition system 114 to execute skip-firing in three cylinders for e.g., 106, 108, and 110 at a time for a maximum of two consecutive working cycles for e.g., working cycles 1 and 2. In another example as shown in FIG. 9, the controller 122 can control the fuel-supply system 104 and the ignition system 114 to execute skip-firing in three cylinders for e.g., 106, 108, and 110 at a time for a maximum of three consecutive working cycles for e.g., working cycles 1, 2, and 3. In another example as shown in FIG. 10, the controller 122 can control the fuel-supply system 104 and the ignition system 114 to execute skip-firing in three cylinders for e.g., 106, 108, and 110 at a time for a maximum of four consecutive working cycles for e.g., working cycles 1, 2, 3 and 4. Similarly, in other examples, the controller 122 can control the fuel-supply system 104 and the ignition system 114 to execute skip-firing in three cylinders for e.g., 106, 108, and 110 at a time for a maximum of five or more consecutive working cycles.

Figure 11:
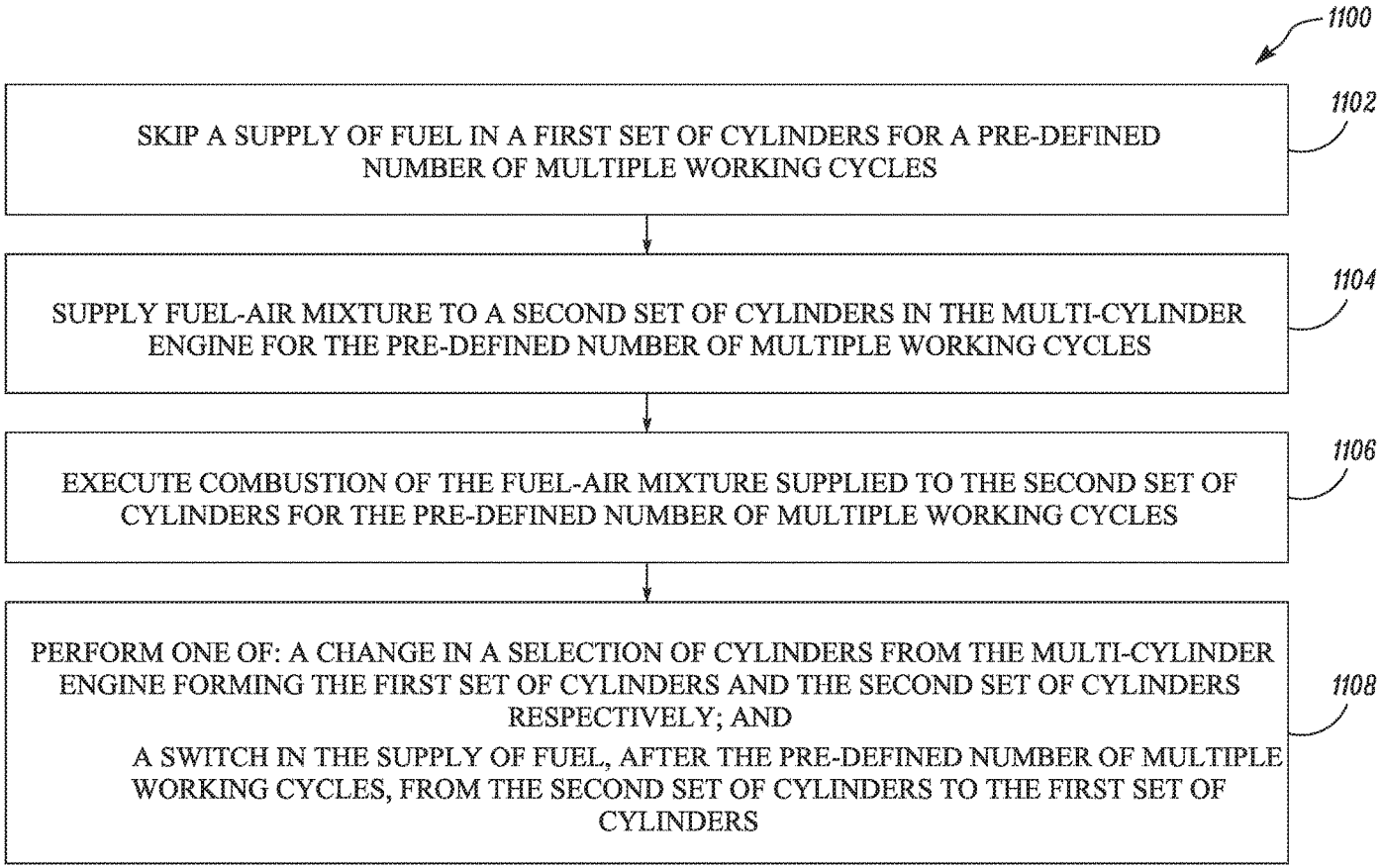
FIG. 11 is a flow chart depicting a process for controlling operation in the multi-cylinder engine of FIG. 1, in accordance with an embodiment of the present disclosure.

FIG. 11 illustrates a process 1100 of controlling operation in a multi-cylinder engine during start of operation and low-load conditions. At block 1102, the method 1100 includes skipping a supply of fuel in the first set of cylinders of the multi-cylinder engine 102 for the pre-defined number of multiple working cycles. At block 1104, the method 1100 further includes, simultaneously or tandemly, supplying fuel-air mixture to a second set of cylinders in the multi-cylinder engine 102 for the pre-defined number of multiple working cycles. At block 1106, the method 1100 further includes executing combustion of the fuel-air mixture supplied to the second set of cylinders for the pre-defined number of multiple working cycles. Thereafter, at block 1108, the method 1100 further includes performing one of: a) a change in a selection of cylinders 106, 108, 110, and 112 from the multi-cylinder engine 102 that form the first set of cylinders and the second set of cylinders respectively (shown in FIGS. 2-4 and FIGS. 8-10); and b) switching the supply of fuel, after the pre-defined number of multiple working cycles, from the second set of cylinders to the first set of cylinders (refer to FIGS. 5-7).

Further, in various embodiments of the present disclosure, it may be noted that during transient operating conditions of the engine 102, the controller 122 can dynamically vary: a) a number of cylinders in the first set of cylinders so as to skip firing in the cylinders 106, 108, 110, and/or 112 that form part of the first set of cylinders, and/or b) a number of working cycles for which one or more cylinders 106, 108, 110, and/or 112 form part of the first set of cylinders so that such cylinders 106, 108, 110, and/or 112 may be devoid of fuel and in which subsequent firing may be omitted or alternatively, continue to occur.

Various embodiments disclosed herein are to be taken in the illustrative and explanatory sense, and should in no way be construed as limiting of the present disclosure. All joinder references (e.g., attached, affixed, coupled, engaged, connected, locked, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

Embodiments of the present disclosure have applicability for use and implementation in improving an ignitability and performance of an engine during start of operation and low-load conditions of the engine. In earlier cases, it has been observed that a quick alternation of skip-firing from one cylinder to the next can potentially cause the average temperature to decrease. Quick alternation disclosed herein can, at the least, be regarded as being representative of one working cycle. Such quick alternation may cause a poor and/or incomplete combustion. Some of the detrimental effects arising out of incomplete combustion could include wastage of fuel, non-compliance with rated emission norms, and the like.

With use of embodiments disclosed herein, a number of cylinders (forming part of the first set of cylinders) can be omitted for a pre-defined number of multiple working cycles, wherein the multiple working cycles are beneficially consecutive in sequence. This way, the fewer number of cylinders (forming part of the second set of cylinders) in which combustion of fuel-air mixture takes place could be effective in mitigating the detrimental effects typically associated with previously known skip-firing strategies. Moreover, a long-term effect of such slow-alternation in the skip-firing between one or more cylinders of engines could include reduced fuel wastage, better fuel economy, and reduced carbon footprint.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A process for controlling operation of a multi-cylinder engine during at least one of a start of operation condition and low-load condition, the multi-cylinder engine including a first cylinder, a second cylinder, a third cylinder, and a fourth cylinder, the process comprising:

skipping a supply of fuel in a first set of cylinders of the multi-cylinder engine for a first pre-defined number of multiple working cycles, the first pre-defined number of multiple working cycles including at least two consecutive working cycles of the multi-cylinder engine, the first set of cylinders including the first cylinder during the first pre-defined number of working cycles;

supplying a fuel-air mixture to a second set of cylinders of the multi-cylinder engine for the first pre-defined number of multiple working cycles, the second set of cylinders including the second cylinder, the third cylinder, and the fourth cylinder during the first pre-defined number of working cycles;

executing combustion of the fuel-air mixture supplied to the second set of cylinders for the first pre-defined number of multiple working cycles;

effecting control of the multi-cylinder engine during a second pre-defined number of working cycles, the second pre-defined number of working cycles occurring immediately after the first pre-defined number of working cycles, the second pre-defined number of working cycles including at least two consecutive working cycles of the multi-cylinder engine;

defining, during the second pre-defined number of working cycles, the first set of cylinders as including the second cylinder;

defining, during the second pre-defined number of working cycles, the second set of cylinders as including the first cylinder, the third cylinder, and the fourth cylinder; and controlling the multi-cylinder engine to skip the supply of fuel to the first set of cylinders and supply the fuel-air mixture to the second set of cylinders during the second pre-defined number of working cycles.

2. The process of claim 1 further comprising performing at least one of:

supplying air into the first set of cylinders; and executing ignition in the first set of cylinders when fuel supply is skipped to the first set of cylinders.

3. The process of claim 1, further comprising dynamically varying a number of cylinders in each of the first and second sets of cylinders during transient operating conditions of the multi-cylinder engine.

4. The process of claim 3, wherein the step of dynamically varying the number of cylinders in each of the first and second sets of cylinders includes determining the number of cylinders to be present in each of the first and second sets of cylinders based on at least one of a load condition, a speed condition of the multi-cylinder engine, and an external input to the multi-cylinder engine.

5. The process of claim 1, further comprising:

effecting control of the multi-cylinder engine during a third pre-defined number of working cycles, the third pre-defined number of working cycles occurring immediately after the second pre-defined number of working cycles, the third pre-defined number of working cycles including at least two consecutive working cycles of the multi-cylinder engine;

defining, during the third pre-defined number of working cycles, the first set of cylinders as including the third cylinder;

defining, during the third pre-defined number of working cycles, the second set of cylinders as including the first cylinder, the second cylinder, and the fourth cylinder; and controlling the multi-cylinder engine to skip the supply of fuel to the first set of cylinders and supply the fuel-air mixture to the second set of cylinders during the third pre-defined number of working cycles.

6. A control system for controlling operation in a multi-cylinder engine having a fuel-supply system and an ignition system coupled thereto, multi-cylinder engine including a first cylinder, a second cylinder, a third cylinder, and a fourth cylinder, the control system comprising:

a sensor module having a plurality of sensors, wherein the plurality of sensors are configured to detect at least one of a start of operation of the multi-cylinder engine, and a low-load condition of the multi-cylinder engine; and a controller communicably coupled to the sensor module, the controller being configured to:

receive signals indicative of at least one of the start of operation of the multi-cylinder engine, and the low-load condition of the multi-cylinder engine;

control the fuel-supply system for:

skipping a supply of fuel in a first set of cylinders during a first pre-defined multiple number of working cycles, the first set of cylinders including the first cylinder and the second cylinder during the first pre-defined number of working cycles, the first pre-defined multiple number of working cycles including at least two consecutive working cycles of the multi-cylinder engine; and supplying fuel-air mixture to a second set of cylinders during the first pre-defined multiple number of working cycles, wherein the second set of cylinders includes the third cylinder and the fourth cylinder during the first pre-defined number of working cycles;

control the ignition system for executing combustion of the fuel-air mixture supplied to the second set of cylinders during the first pre-defined number of multiple working cycles;

effect control of the multi-cylinder engine during a second pre-defined number of working cycles, the second pre-defined number of working cycles occurring immediately after the first pre-defined number of working cycles, the second pre-defined number of working cycles including at least two consecutive working cycles of the multi-cylinder engine;

define, during the second pre-defined number of working cycles, the first set of cylinders as including the third cylinder and the fourth cylinder;

define, during the second pre-defined number of working cycles, the second set of cylinders as including the first cylinder and the second cylinder; and control the fuel-supply system to skip the supply of fuel to the first set of cylinders and supply the fuel-air mixture to the second set of cylinders during the second pre-defined number of working cycles.

7. The control system of claim 6, wherein the pre-defined number of multiple working cycles includes at least four consecutive working cycles of the multi-cylinder engine.

8. The control system of claim 6, wherein the first set of cylinders includes at least one cylinder of the multi-cylinder engine.

9. The control system of claim 6, wherein the second set of cylinders includes at least one cylinder of the multi-cylinder engine.

10. The control system of claim 6, wherein the controller is further configured to dynamically vary a number of cylinders in each of the first and second sets of cylinders during transient operating conditions of the multi-cylinder engine.

11. The control system of claim 10, wherein the controller is further configured to determine the number of cylinders to be present in each of the first and second sets of cylinders based on at least one of a load condition, a speed condition of the multi-cylinder engine, and an external input to the multi-cylinder engine.

12. The control system of claim 6, wherein the controller is further configured to effect control of the multi-cylinder engine during a third pre-defined number of working cycles, the third pre-defined number of working cycles occurring immediately after the second pre-defined number of working cycles, the third pre-defined number of working cycles including at least two consecutive working cycles of the multi-cylinder engine, wherein, during the third pre-defined number of working cycles, the controller is further configured to:

define the first set of cylinders as including the first cylinder and the second cylinder, define the second set of cylinders as including the third cylinder and the fourth cylinder, and control the fuel-supply system to skip the supply of fuel to the first set of cylinders and supply the fuel-air mixture to the second set of cylinders.

13. An engine system comprising:

an engine having multiple cylinders including a first cylinder, a second cylinder, a third cylinder, and a fourth cylinder;

a fuel-supply system fluidly coupled to the engine and configured to operatively deliver a supply of fuel to the engine;

an ignition system coupled to the engine and configured to operatively execute ignition in the engine;

a plurality of sensors configured to detect at least one of a start of operation of the engine and a low-load condition of the engine; and a controller communicably coupled to the plurality of sensors, the controller being configured to:

receive signals indicative of at least one of the start of operation of the engine, and the low-load condition of the engine;

control the fuel-supply system to:

skip the supply of fuel in a first set of cylinders for a first pre-defined multiple number of working cycles, the first set of cylinders including the first cylinder during the first pre-defined number of working cycles, the first pre-defined multiple number of working cycles including at least two consecutive working cycles of the engine; and supply a fuel-air mixture to a second set of cylinders for the first pre-defined multiple number of working cycles, the second set of cylinders including the second cylinder, the third cylinder, and the fourth cylinder during the first pre-defined number of working cycles;

control the ignition system to effect combustion of the fuel-air mixture supplied to the second set of cylinders for the first pre-defined number of multiple working cycles; and effect control of the engine system during a second pre-defined number of working cycles, the second pre-defined number of working cycles occurring immediately after the first pre-defined number of working cycles, the second pre-defined number of working cycles including at least two consecutive working cycles of the engine;

define, during the second pre-defined number of working cycles, the first set of cylinders as including the second cylinder;

define, during the second pre-defined number of working cycles, the second set of cylinders as including the first cylinder, the third cylinder, and the fourth cylinder; and control the fuel-supply system to skip the supply of fuel to the first set of cylinders and supply the fuel-air mixture to the second set of cylinders during the second pre-defined number of working cycles.

14. The engine system of claim 13, wherein the first set of cylinders includes at least one cylinder of the engine.

15. The engine system of claim 13, wherein the second set of cylinders includes at least one cylinder of the engine.

16. The engine system of claim 13, wherein the controller is further configured to dynamically vary a number of cylinders in each of the first and second sets of cylinders during transient operating conditions of the engine.

17. The engine system of claim 13, wherein the controller is further configured to determine a number of cylinders to be present in each of the first and second sets of cylinders based on at least one of a load condition, a speed condition of the engine, and an external input to the engine.

18. The engine system of claim 13, wherein the controller is further configured to effect control of the engine system during a third pre-defined number of working cycles, the third pre-defined number of working cycles occurring immediately after the second pre-defined number of working cycles, the third pre-defined number of working cycles including at least two consecutive working cycles of the engine, wherein, during the third pre-defined number of working cycles, the controller is further configured to:

define the first set of cylinders as including the third cylinder, define the second set of cylinders as including the first cylinder, the second cylinder, and the fourth cylinder, and control the fuel-supply system to skip the supply of fuel to the first set of cylinders and supply the fuel-air mixture to the second set of cylinders during the third pre-defined number of working cycles.

19. The engine system of claim 18, wherein the controller is further configured to effect control of the engine system during a fourth pre-defined number of working cycles, the fourth pre-defined number of working cycles occurring immediately after the third pre-defined number of working cycles, the fourth pre-defined number of working cycles including at least two consecutive working cycles of the engine, wherein, during the fourth pre-defined number of working cycles, the controller is further configured to:

define the first set of cylinders as including the fourth cylinder, define the second set of cylinders as including the first cylinder, the second cylinder, and the third cylinder, and control the fuel-supply system to skip the supply of fuel to the first set of cylinders and supply the fuel-air mixture to the second set of cylinders.

* * * * *